US008157552B2

(12) United States Patent
Kurokawa et al.

(10) Patent No.: US 8,157,552 B2
(45) Date of Patent: Apr. 17, 2012

(54) ROTARY FLUID PRESSURE DEVICE AND IMPROVED PARKING LOCK ASSEMBLY THEREFOR

(75) Inventors: Michio Kurokawa, Kameoka (JP); Shoji Nakazawa, Kameoka (JP); Hisatoshi Sakurai, Kameoka (JP)

(73) Assignee: Eaton Corporation, Cleveland, OH (US)

( * ) Notice: Subject to any disclaimer, the term of this patent is extended or adjusted under 35 U.S.C. 154(b) by 718 days.

(21) Appl. No.: 12/160,624

(22) PCT Filed: Jan. 22, 2007

(86) PCT No.: PCT/IB2007/000141

§ 371 (c)(1),
(2), (4) Date: Jul. 11, 2008

(87) PCT Pub. No.: WO2007/083232

PCT Pub. Date: Jul. 26, 2007

(65) Prior Publication Data

US 2010/0166590 A1 Jul. 1, 2010

Related U.S. Application Data

(60) Provisional application No. 60/761,021, filed on Jan. 20, 2006.

(51) Int. Cl.
*F01C 1/10* (2006.01)
*F03C 2/00* (2006.01)
*F16D 65/24* (2006.01)

(52) U.S. Cl. ..... 418/61.3; 418/181; 188/170

(58) Field of Classification Search ..... 418/61.3, 418/181; 188/170
See application file for complete search history.

(56) References Cited

U.S. PATENT DOCUMENTS

| | | | |
|---|---|---|---|
| 3,616,882 | A | 11/1971 | White |
| 3,960,470 | A | 6/1976 | Kinder |
| 4,445,423 | A | 5/1984 | Louhio |
| 4,493,404 | A | 1/1985 | Wenker |
| 4,597,476 | A | 7/1986 | Wenker |
| 4,981,423 | A | 1/1991 | Bissonnette |
| 5,114,324 | A | 5/1992 | Spindeldreher |
| 6,030,194 | A | 2/2000 | Yakimow et al. |
| 6,062,835 | A | 5/2000 | Acharya et al. |
| 6,132,194 | A | 10/2000 | Wenker et al. |
| 6,345,968 | B1 | 2/2002 | Shupe |
| 6,743,002 | B1 | 6/2004 | Millar |
| 7,287,969 | B2 | 10/2007 | Fugle |

FOREIGN PATENT DOCUMENTS

| | | | |
|---|---|---|---|
| JP | 59 153983 | | 9/1984 |
| JP | 59153983 A | * | 9/1984 |
| JP | 2001 082313 A | | 3/2001 |

* cited by examiner

*Primary Examiner* — Mary A Davis
(74) *Attorney, Agent, or Firm* — Merchant & Gould P.C.

(57) ABSTRACT

A rotary fluid pressure device (11) includes an end cap (23) which is disposed rearwardly of, and adjacent, the fluid displacement mechanism (21). The end cap defines a piston cavity (103) in which is disposed a lock piston (105), which is moveable between a first position and a second position, in which the forward portion (107) of the lock piston extends within a central opening (121) of a rotor member (49) to prevent movement. A release piston (137) is disposed in a central opening (125) of one of the housing member (13) and stationary valve member (63). A brake pin (141) is disposed in a bore (139) of a drive shaft (57), with a first axial end of the brake pin being operably associated with release piston and a second axial end being operably associated with the lock piston.

20 Claims, 6 Drawing Sheets

ROTARY FLUID PRESSURE DEVICE AND IMPROVED PARKING LOCK ASSEMBLY THEREFOR

CROSS-REFERENCE TO RELATED APPLICATIONS

This application is a National Stage Application of PCT/IB2007/000141, filed Jan. 22, 2007, which application claims priority to U.S. Provisional application Ser. No. 60/761,021, filed Jan. 20, 2006, in the name of Michio Kurokawa, Shoji Nakazawa, and Kisatoshi Sakurai for a "Rotary Fluid Pressure Device and Improved Parking Lock Assembly Therefor".

BACKGROUND

1. Field of the Invention

The present invention relates to rotary fluid pressure devices, and more particularly, to a parking lock for such devices.

2. Description of the Related Art

In many vehicle applications for low-speed, high-torque gerotor motors, it is desirable for the motor to have some sort of parking brake or parking lock, the term "lock" being preferred because it is intended that the parking lock be engaged only after the vehicle is stopped. In other words, such parking lock devices are not intended to be dynamic brakes, which would be engaged while the vehicle is moving, to bring the vehicle to a stop.

For many years, those skilled in the art have attempted to incorporate brake and lock devices into gerotor motors, as opposed to merely adding a brake package on the motor output shaft. Examples of such devices are illustrated and described in U.S. Pat. Nos. 3,616,882 and 4,981,423. In the device of U.S. Pat. No. 3,616,882, a braking element is disposed adjacent the forward end of the gerotor star, and is biased by fluid pressure into frictional engagement therewith. Such an arrangement involves a certain degree of unpredictability of performance, in view of variations in clearances, etc. Such an arrangement also requires a substantial redesign of the wear plate and forward bearing housing of the motor. In the device of U.S. Pat. No. 4,981,423, there is a multi-disc brake assembly which is of the "spring-applied, pressure-released" type. The arrangement of the '423 patent also requires almost total redesign of the forward bearing housing, and also results in a much larger bearing housing. In addition, the disc pack is in splined engagement with the output shaft and, therefore, must be able to brake or hold the full output torque of the motor, thus necessitating that the discs, the spring, and the apply/release piston all be relatively larger.

Another example of the incorporation of brake and lock devices into gerotor motors is illustrated and described in U.S. Pat. No. 6,062,835, assigned to the assignee of the present invention and incorporated herein by reference. In the device of the '835 patent, a lock piston is disposed in an internal chamber of an end cap assembly, located immediately adjacent to the gerotor gear set: A spring biases the lock piston into engagement with the gerotor gear set when hydraulic pressure is not supplied to the device. When hydraulic pressure is supplied to the device, this hydraulic pressure acts against the lock piston to disengage the piston from the gerotor gear set. Although the device in the '835 patent is compact and would function successfully in many hydraulic applications, some current manufacturers of hydraulic applications, including but not limited to miniexcavator manufacturers, have placed greater size restrictions on gerotor motors while still requiring a parking brake or parking lock feature.

BRIEF SUMMARY

The present invention provides a rotary fluid pressure device comprising a housing member and a valve member, which provides fluid communication between the housing member and a gerotor displacement member. A central opening is defined by a member selected from the group consisting of the housing member, the valve member, and any combinations thereof. A release piston member, which is moveable between a first position and a second position, is disposed in the central opening. An end cap is disposed adjacent the gerotor displacement mechanism and defines a piston cavity. A lock piston member, which is moveable between a first position and a second position, is disposed in the piston cavity. A drive shaft is disposed between the release piston member and the lock piston member. The drive shaft defines an axial bore, in which is disposed a pin member. The pin member defines a first axial end, which is operably associated with the release piston member, and a second axial end, which is operably associated with the lock piston member.

BRIEF DESCRIPTION OF THE DRAWINGS

The accompanying drawings are included to provide a further understanding of the present invention and are incorporated in and constitute part of this specification. The drawings illustrate exemplary embodiments of the present invention and together with the description serve to further explain the principles of the invention, wherein.

DETAILED DESCRIPTION

Although the present invention may be included in a gerotor type device being utilized as a pump, it is especially adapted for use in a low-speed high-torque gerotor motor, and will be described in connection therewith.

Figure 1:
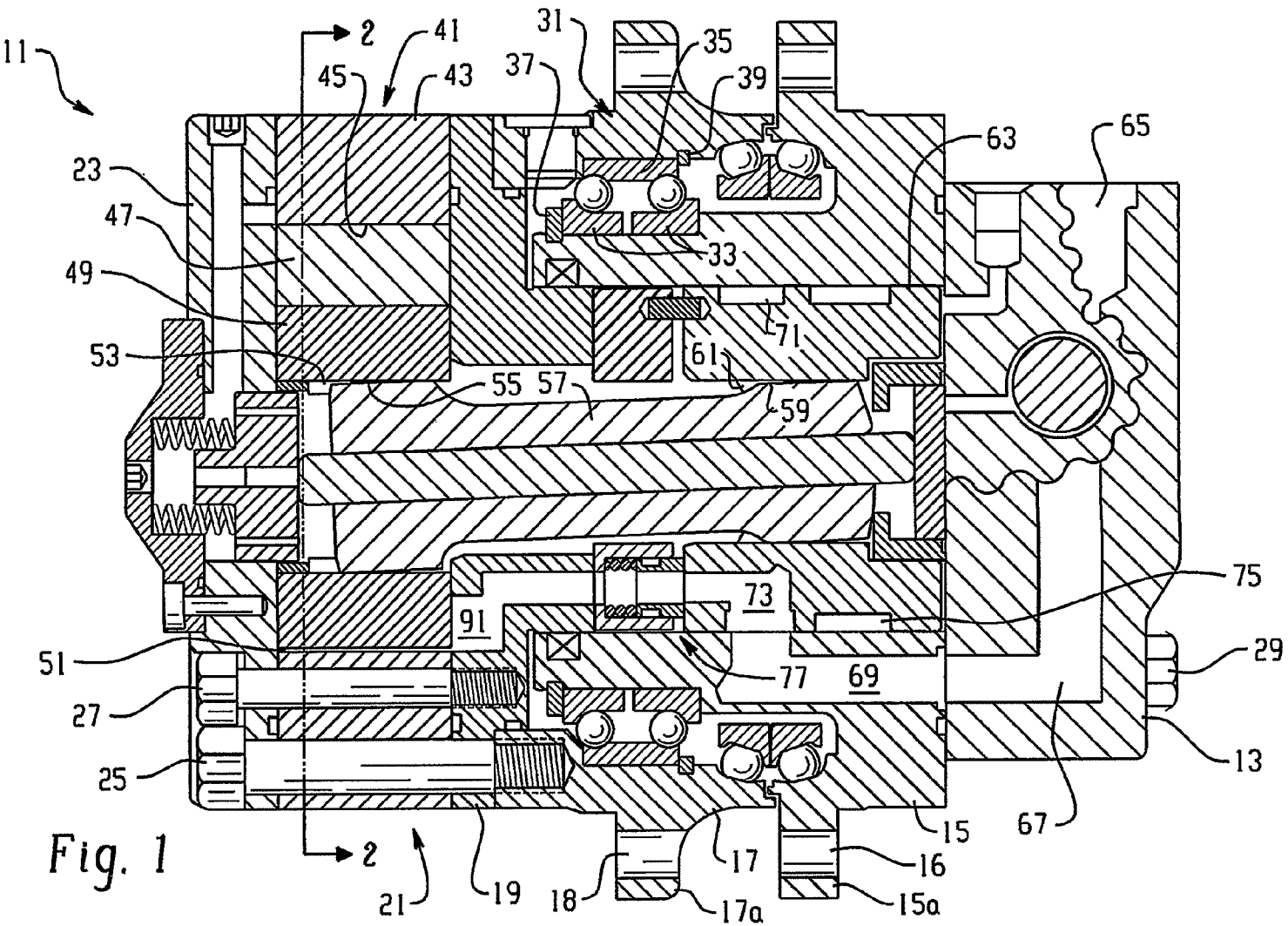
FIG. 1 is an axial cross section of a rotary fluid pressure device of the type which may embody the present invention and includes a fragmentary section taken on a different plane.

Referring now to the drawings, which are not intended to limit the invention, FIG. 1 illustrates an axial cross-section of a rotary fluid pressure device of the type with which the parking lock mechanism of the present invention is especially advantageous. The rotary fluid pressure device, generally designated 11, includes a housing member 13, a valve housing 15, a mounting plate 17, a valve plate 19, a gerotor displacement mechanism, generally designated 21, and an end cap 23. The valve housing 15 includes a flange 15*a* that defines a plurality of mounting holes 16 for rigidly mounting the rotary fluid pressure device 11 to a hydraulic application. The mounting plate 17 also includes a flange 17*a* that defines a plurality of mounting holes 18 for mounting the rotary fluid pressure device 11 to a rotating component (such as a wheel or sprocket) of the hydraulic application. The end cap 23, the gerotor displacement mechanism 21, the valve plate 19, and the mounting plate 17 are held together in tight sealing engagement by means of a plurality of bolts 25 in threaded engagement with the mounting plate 17. The end cap 23, the gerotor displacement mechanism 21 and the valve plate 19 are further held in tight sealing engagement by a plurality of bolts 27 in threaded engagement with the valve plate 19. The housing member 13 and the valve housing 15 are held in tight sealing engagement by a plurality of bolts 29 in threaded engagement with the valve housing 15. As a result of this tight sealing engagement between the housing member 13 and the valve housing 15, the term "housing member" in the appended claims may refer to the housing member 13 and valve housing 15 individually or in combination. The valve housing 15 and the mounting plate 17 are held in engagement by a bearing assembly, generally designated 31. The bearing assembly 31 includes an inner race 33 and an outer race 35. The inner race 33 of the bearing assembly 31 is in a press fit engagement with the valve housing 15, while the outer race 35 of the bearing assembly 31 is in a press fit engagement with the mounting plate 17. The engagement of the inner race 33 of the bearing assembly 31 and the valve housing 15 is retained by a retainer member 37. The engagement of the outer race 35 of the bearing assembly 31 and the mounting plate 17 is retained by a retainer member 39.

Figure 2:
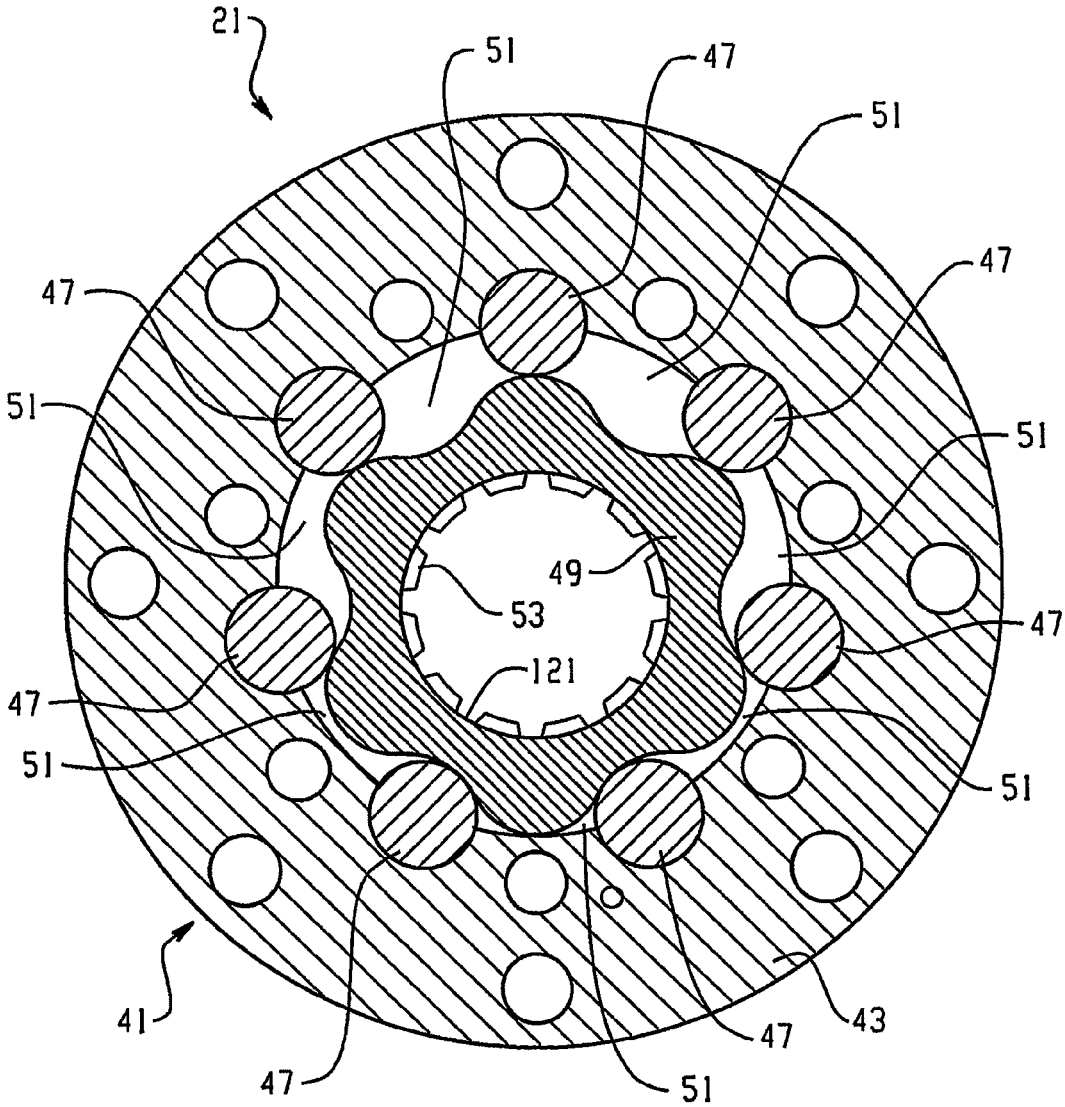
FIG. 2 is a transverse cross-section of the gerotor displacement mechanism of the subject embodiment taken on line 2-2 in FIG. 1.

Referring now to FIGS. 1 and 2, the gerotor displacement mechanism 21 is well known in the art and will therefore be described only briefly herein. More specifically, in the subject embodiment, the gerotor displacement mechanism 21 is a Geroler® displacement mechanism comprising an internally toothed assembly 41. The internally toothed assembly 41 comprises a ring member 43 which defines a plurality of generally semi-cylindrical openings 45. Rotatably disposed within each of the semi-cylindrical openings 45 is a cylindrical member 47, as is now well known in the art. Eccentrically disposed within the internally toothed assembly 41 is a rotationally stationary externally toothed rotor member 49, typically having one less external tooth than the number of cylindrical members 47, thus permitting the externally toothed rotor member 49 to orbit relative to the internally toothed assembly 41 and the internally toothed assembly 41 to rotate relative to the externally toothed rotor member 49. The relative orbital and rotational movement between the internally toothed assembly 41 and the externally toothed rotor member 49 defines a plurality of expanding and contracting fluid volume chambers 51. The externally toothed rotor member 49 defines a set of internal splines 53 formed at the inside diameter of the rotor member 49. The internal splines 53 of the rotor member 49 are in engagement with a set of external, crowned splines 55 on a main drive shaft 57. Disposed at the opposite end of the main drive shaft 57 is another set of external, crowned splines 59, for engagement with a set of internal splines 61 in a stationary valve member 63.

Referring again to FIG. 1, the housing member 13 defines a fluid port 65 which is in fluid communication with a fluid passage 67. The valve housing 15 defines a fluid passage 69 which is in open fluid communication with the fluid passage 67 in the housing member 13. Disposed within the valve housing 15 in an interference fit engagement is the stationary valve member 63. The stationary valve member 63 defines an annular groove 71 which is in open fluid communication with the fluid passage 69 in the valve housing 15. The stationary valve member 63 further defines a plurality of fluid passages 73 which are in open fluid communication with the annular groove 71. In the subject embodiment and by way of example only, there are six fluid passages 73 which are in open fluid communication with the annular groove 71, the passages 73 being alternately arranged in the stationary valve member 63 with six fluid passages (not shown) which are in open fluid communication with an annular groove 75.

Figure 3:
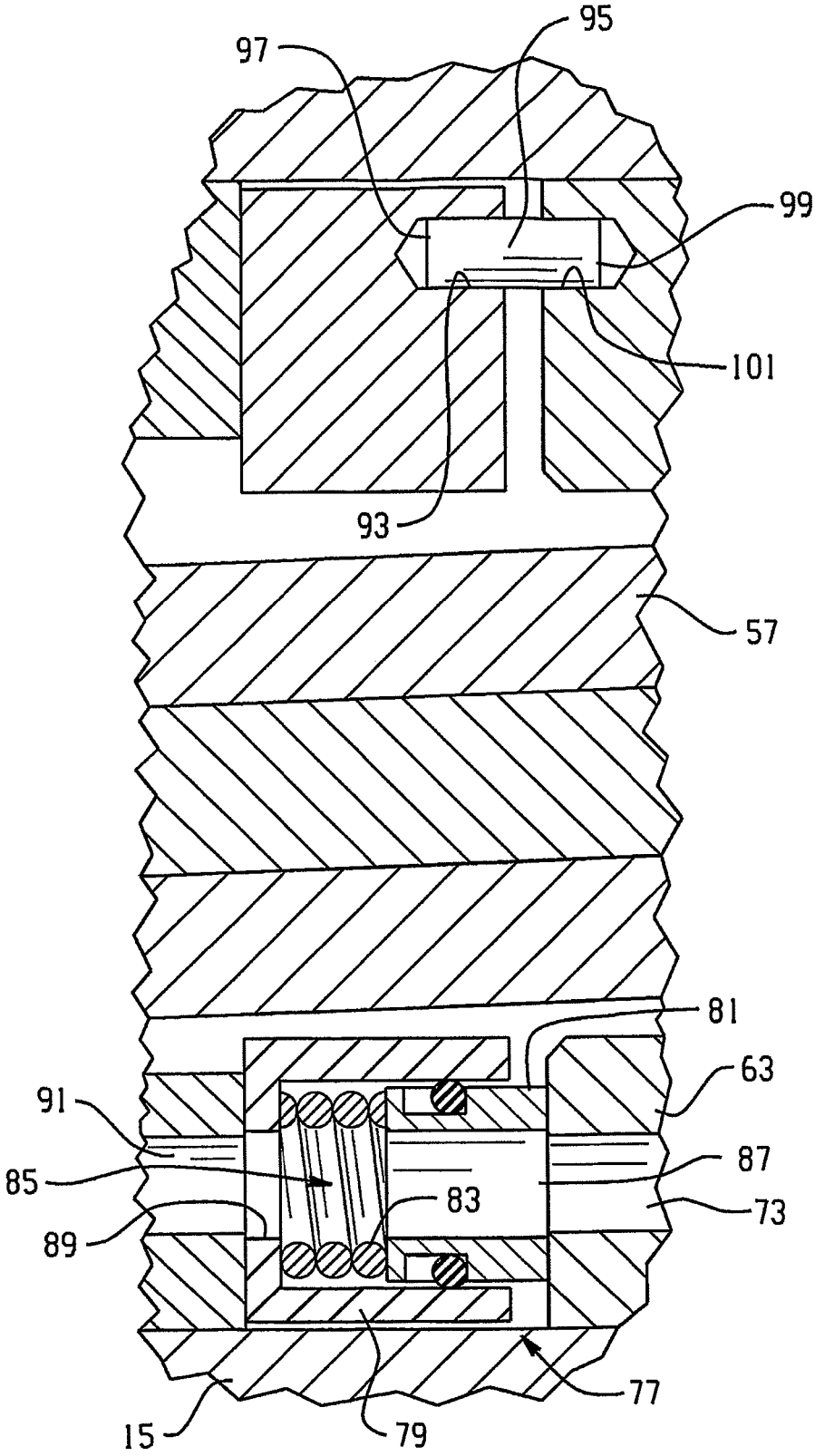
FIG. 3 is an enlarged, fragmentary axial cross section of the valve ring assembly of the subject embodiment.

Referring now to FIGS. 1 and 3, a valve ring assembly, generally designated 77, is disposed adjacent to the stationary valve member 63. The valve ring assembly 77 includes a valve ring 79, a plurality of valve pistons 81, and a plurality of springs 83. The valve ring 79 defines a plurality of valve cavities 85. One of the plurality of valve pistons 81 is disposed in each valve cavity 85. Each valve piston 81 defines a fluid passage 87, which is in open fluid communication with the adjacent fluid passage in the stationary valve member 63. One of the plurality of springs 83 is also disposed in each valve cavity 85 between the valve ring 79 and the valve piston 81. Each spring 83 biases its respective valve piston 81 into the stationary valve member 63 to provide sealing engagement between the valve piston 81 and the stationary valve member 63. The valve ring 79 further defines a plurality of fluid passages 89 which are in commutating fluid communication with a plurality of valve passages 91 in the valve plate 19. Each valve passage 91 is in open fluid communication with one of the plurality of expanding or contracting fluid volume chambers 51.

Referring now primarily to FIG. 3, the valve ring 79 further defines a plurality of constraint holes 93, and each of the constraint holes 93 has associated therewith a pin member 95 including a first axial end 97 and a second axial end 99. The second axial ends 99 are disposed in a plurality of constraint holes 101 defined by the stationary valve member 63. The pin members 95 are disposed in the constraint holes 93 of the valve ring 79 and constraint holes 101 of the stationary valve member 63 in order to prevent rotation of the valve ring 79 with respect to the stationary valve member 63.

Referring now to FIGS. 1, 2 and 3, pressurized fluid entering the rotary fluid pressure device 11 through the fluid port 65 in the housing member 13 will flow through the fluid passage 67 and into the fluid passage 69 in the valve housing 15. The pressurized fluid will then flow through the annular groove 71 and into the fluid passage 73 in the stationary valve member 63. The pressurized fluid enters the valve cavity 85 through the fluid passage 87 in the valve piston 81. From the valve cavity 85, the pressurized fluid flows through the fluid passage 89 in the valve ring 79 and into the valve passages 91 in the valve plate 19 which are in commutating fluid communication with the fluid passage 89. The pressurized fluid will then enter the expanding fluid volume chambers 51 in the gerotor displacement mechanism 21 through the adjacent valve passages 91 in the valve plate 19. As is well known to those skilled in the art, the previously described flow will result in orbital movement of the externally toothed rotor member 49 and rotational movement of the internally toothed assembly 41.

Exhaust fluid will flow from the contracting fluid volume chambers 51 along a path similar to that previously described to the annular groove 75 in the stationary valve member 63 and out a fluid port 102 (not shown in FIG. 1, but shown schematically in FIG. 4) in the housing member 13.

Figure 4:
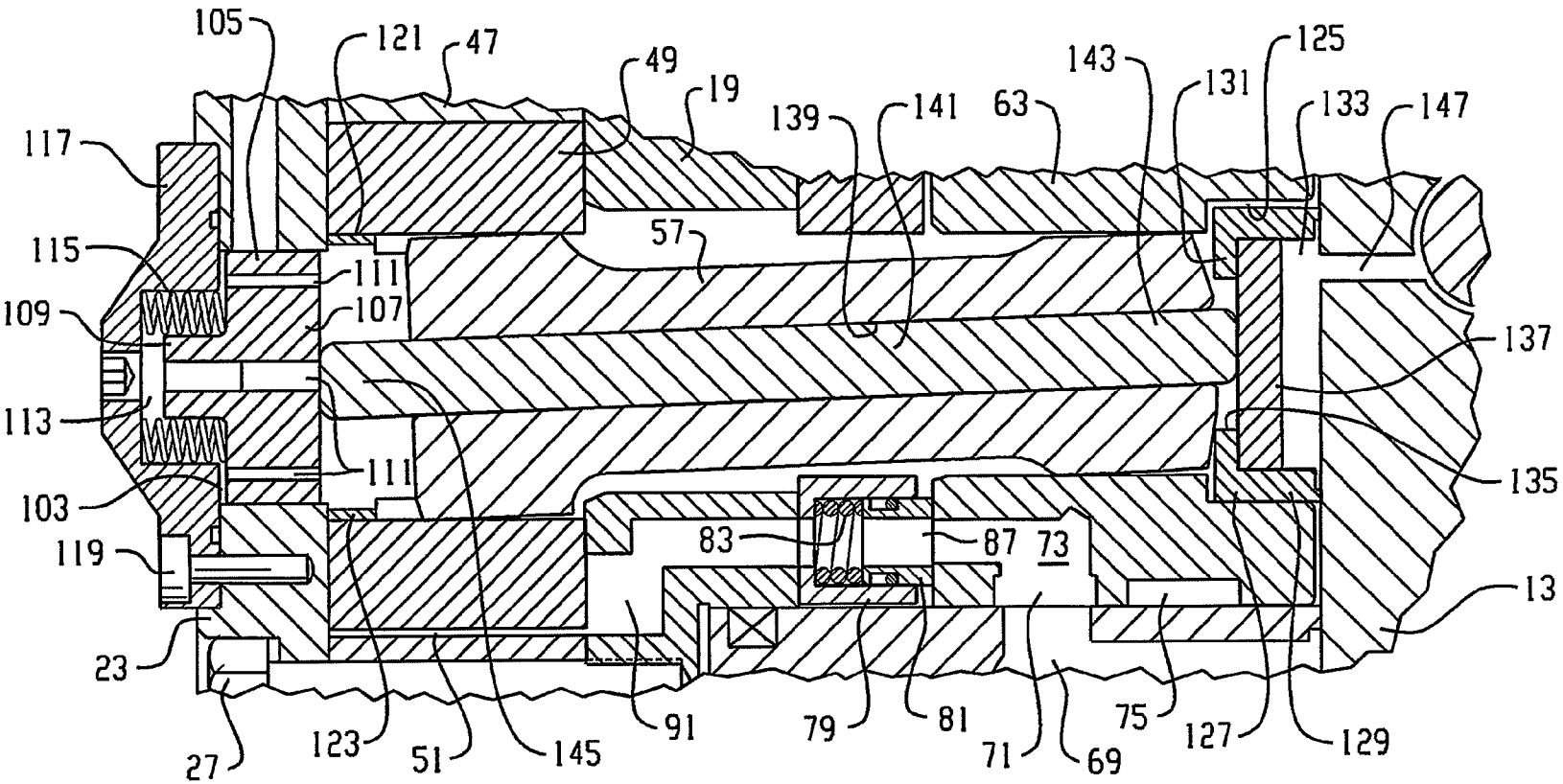
FIG. 4 is an enlarged, fragmentary axial cross section, similar to FIG. 1, of a rotary fluid pressure device illustrating the parking lock mechanism of the present invention in the first position.

Referring now to FIG. 4, with reference made to elements introduced in FIGS. 1, 2 and 3, the parking lock mechanism will now be described. The end cap 23 defines a piston cavity 103, which in the subject embodiment is generally cylindrical. While the figures show the piston cavity 103 in the end cap, it will be understood by those skilled in the art that the piston cavity 103 could also be defined by a plate member (not shown) that is adjacent the gerotor displacement mechanism 21. Therefore, it will be understood that the term "end cap" as used in the appended claims would include a plate member that is adjacent to the gerotor displacement mechanism 21. Disposed within the piston cavity 103 in the end cap 23 is a lock piston 105, which in the subject embodiment is also generally cylindrical. The lock piston 105 includes a forward portion 107 and a rearward portion 109. In the subject embodiment, the forward portion 107 of the lock piston 105 has a larger diameter than the rearward portion 109 of the lock piston 105. However, it will be understood by those skilled in the art that the scope of the present invention is not limited to the forward portion 107 having a larger diameter than the rearward portion 109. The diameter of the forward portion 107 of the lock piston 105 is slightly smaller than the diameter of the piston cavity 103 in the end cap 23. This diametrical clearance between the lock piston 105 and the piston cavity 103 allows for axial movement of the lock piston 105 relative to the piston cavity 103. In the subject embodiment, the lock piston 105 further defines at least one hole 111 that maintains substantially equal fluid pressure around the lock piston 105. However, it will be understood by those skilled in the art that the scope of the present invention is not limited to the lock piston 105 containing the hole 111. Disposed rearwardly of the lock piston 105 in a spring cavity 113 is a spring 115. In the subject embodiment, there is a cover plate 117 which is held in tight sealing engagement with the end cap 23 by a plurality of bolts 119. The cover plate 117 cooperates with the lock piston 105 to define the spring cavity 113. It should be understood by those skilled in the art, however, that the spring cavity 113 could alternatively be disposed in the end cap 23.

The externally toothed rotor member 49 defines a central opening 121 at the axial end of the rotor member 49 which is adjacent to the end cap 23. Disposed in the central opening 121 of the rotor member 49 is a lock collar 123. The inner diameter of the lock collar 115 is slightly larger than the diameter of the forward portion 107 of the lock piston 105.

Referring still to FIG. 4, the stationary valve member 63 of the subject embodiment defines a central opening 125 in which is disposed a release piston ring 127. Although the central opening 125 is shown in the stationary valve member 63 in the subject embodiment, those skilled in the art will recognize that the central opening 125 could alternatively be disposed in the housing member 13, as that term has been defined above, or a plate member (not shown) that is adjacent to the housing member 13. Therefore, it will be understood by those skilled in the art that the term "housing member" as used in the appended claims may further refer to the plate member (not shown). The release piston ring 127 includes a forward portion 129 and a rearward portion 131. The forward portion 129 of the release piston ring 127 defines a release piston cavity 133. The rearward portion 131 of the release piston ring 127 defines a bore 135, the diameter of which is smaller than the diameter of the release piston cavity 133. Disposed in sliding engagement with the release piston cavity 133 of the release piston ring 127 is a release piston 137. In the subject embodiment, the diametral clearance between the release piston 137 and the release piston cavity 133 is small enough to prevent or reduce fluid leakage around the release piston while still allowing axial movement of the release piston 137 relative to the release piston ring 127. It should be understood, however, that fluid leakage around the release piston 137 could also be prevented or reduced by the use of a sealing member (not shown), such as an o-ring or a reciprocating seal, between the release piston 137 and the release piston cavity 133.

Disposed between the lock piston 105 and the release piston 137 is the main drive shaft 57. The main drive shaft 57 defines a pin bore 139 which extends along the entire axial length of the main drive shaft 57. A brake pin 141, which includes a first axial end 143 and a second axial end 145, is disposed in sliding engagement in the pin bore 139 in the main drive shaft 57. The axial length of the brake pin 141 is longer than the axial length of the main drive shaft 57. The first axial end 143 of the brake pin 141 extends through the bore 135 in the rearward portion 131 of the release piston ring 127 and is operably associated with the release piston 137. The second axial end 145 of the brake pin 141 is operably associated with the lock piston 105.

Referring still to FIG. 4, when the release piston cavity 133 is subjected to pressurized fluid from the housing member 13 through a fluid passage 147, in a manner which will be described in greater detail subsequently, the release piston 137 moves to the rearward portion 131 of the release piston ring 127, hereinafter referred to in the appended claims as the "first position." While the release piston 137 moves towards the rearward portion 131 of the release piston ring 127, the release piston 137 engages the first axial end 143 of the brake pin 141. The force exerted on the release piston 137 by the pressurized fluid from the housing member 13 causes the brake pin 141 to slide in the pin bore 139 of the main drive shaft 57 toward the lock piston 105 causing the second axial end 145 of the brake pin 139 to engage the lock piston 105. If the force exerted on the release piston 137 is greater than the force exerted on the lock piston 105 by the spring 115 disposed in the spring cavity 113, the lock piston 105 will disengage from the lock collar 123 and move axially toward the spring cavity 103 in the cover plate 117, thereby allowing the rotor member 49 to orbit relative to the internally toothed assembly 41 and the internally toothed assembly 41 to rotate relative to the rotor member 49. This position of the lock piston 105, as shown in FIG. 4, will be referred to hereinafter in the appended claims as the "first position."

Figure 5:
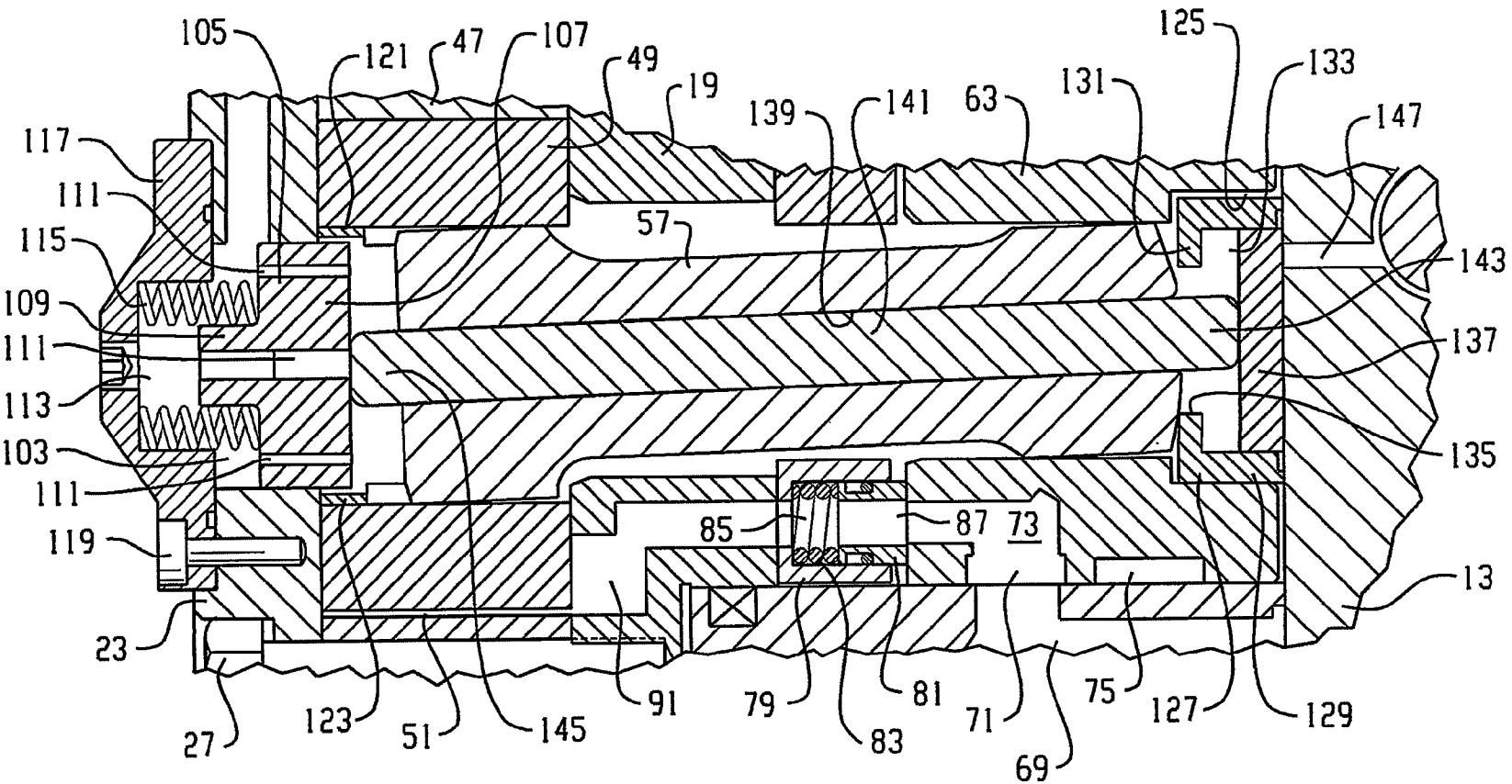
FIG. 5 is an enlarged fragmentary axial cross section, similar to FIG. 1, of a rotary fluid pressure device illustrating the parking lock mechanism of the present invention in the second position.

Referring now to FIG. 5, when the pressurized fluid in the fluid passage 147 in the housing member 13 is vented or relieved, the spring 115 in the spring cavity 113 biases the lock piston 105 into sliding engagement with the rearward face of the rotor member 49. After the rotor member 49 has orbited a sufficient amount such that the central opening 121 of the rotor member 49 is coaxial with the cavity 103 in the end cap 23 (which occurs once per orbit of the rotor 49), the spring 115 biases the lock piston 105 into the engaged position (as shown in FIG. 5) with the lock piston collar 123 in the central opening 121 of the rotor member 49, thereby prohibiting the relative rotation and orbit of the internally toothed assembly 41 and the externally toothed rotor member 49. This position of the lock piston 105, as shown in FIG. 5, will be referred to hereinafter in the appended claims as the "second position." As the lock piston 105 moves into engagement with the lock piston collar 121, the lock piston 105 engages the second axial end 145 of the brake pin 141. The force exerted by the spring 115 on the lock piston 105 is transmitted through the brake pin 141 and acts on the release piston 137 through the engagement of the first axial end 143 of the brake pin 141 with the release piston 137. With the spring force acting on the release piston 137 through the brake pin 141 and the pressurized fluid in the fluid passage 147 in the housing member 13 relieved, the release piston 137 moves to the forward portion 129 of the release piston ring 127, hereinafter referred to in the appended claims as the "second position."

Figure 6:
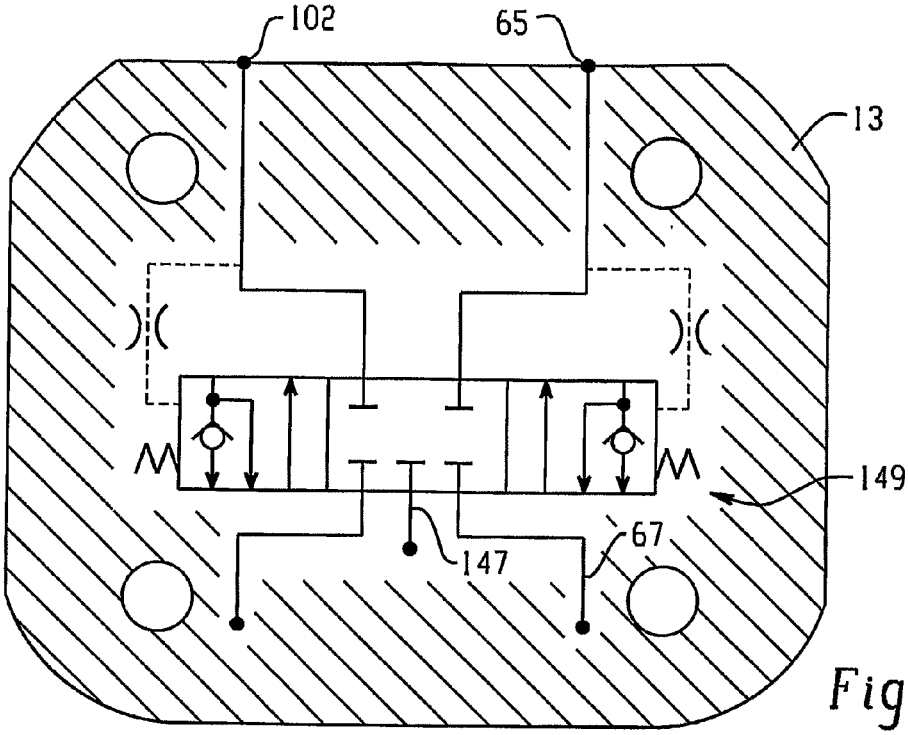
FIG. 6 is a hydraulic schematic of a housing member made in accordance with the present invention.

Referring now to FIG. 6, the housing member 13 is shown schematically to illustrate how pressurized fluid is supplied to the fluid passage 147 in the housing member 13. In the subject embodiment, but by way of example only, pressurized fluid is supplied to the fluid passage 147 through a 3-position, 5-way valve assembly, generally designated 149. As the operation of this type of valve is well known to those skilled in the art, a detailed description, beyond the schematic, will not be provided herein.

Figure 7:
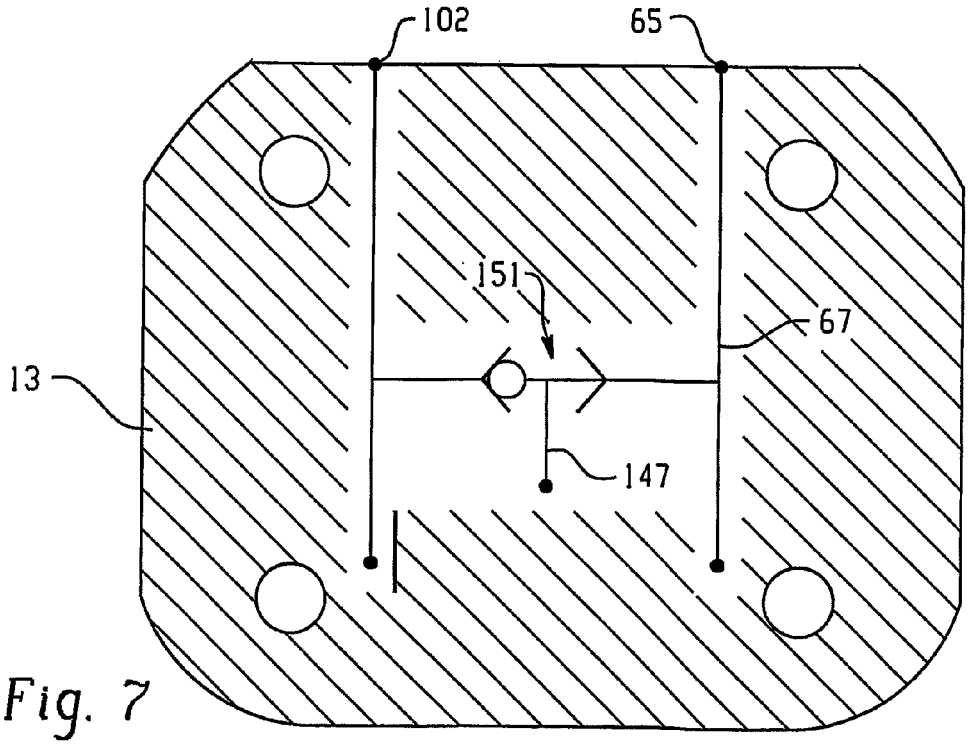
FIG. 7 is a hydraulic schematic of an alternate embodiment of a housing member made in accordance with the present invention.

Referring now to FIG. 7, an alternate embodiment of the housing member 13 is shown schematically to illustrate how pressurized fluid is supplied to the fluid passage 147 in the housing member 13. In the alternate embodiment illustrated in FIG. 6, pressurized fluid is supplied to the fluid passage 147 through a shuttle valve assembly, generally designated 151. As is well known to those skilled in the art, the shuttle valve assembly 151 allows pressurized fluid from fluid port 65 or fluid port 102 to flow to the fluid passage 147 while prohibiting direct fluid communication between fluid port 65 and fluid port 102.

In addition to the three-position, five-way valve assembly 149 shown in FIG. 6 and the shuttle valve assembly 151 shown in FIG. 7, an alternate embodiment of the housing member 13 could allow pressurized fluid to be directly supplied to the fluid passage 147 from a source of pressurized fluid (such as a charge pump) located elsewhere on the hydraulic application through a fluid port (not shown) in the housing member 13.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device comprising:
- a housing member defining a fluid inlet and a fluid outlet;
- a valve member in fluid communication with the fluid inlet and the fluid outlet;
- a gerotor displacement mechanism in fluid communication with the valve member, the gerotor displacement mechanism including:
  - a ring member defining an axis, wherein the ring member rotates about the axis;
  - a rotor member eccentrically disposed in the ring member, the rotor member orbiting about the axis of the ring member, the rotor member defining a central opening;
- a drive shaft engaged to the rotor member, the drive shaft defining an axial bore that extends through the drive shaft;
- a brake pin slidably disposed in the axial bore of the drive shaft, the brake pin having a first axial end and a second axial end;
- a release piston disposed against the first axial end of the brake pin; and
- a lock piston acting against the second axial end of the brake pin, the lock piston being moveable between an engaged position and a disengaged position, the lock piston being disposed in the central opening of the rotor member in the engaged position to prevent the rotor member from orbiting, the release piston acting against the first axial end of the brake pin to move the lock piston to the disengaged position.

2. A rotary fluid pressure device as claimed in claim 1, further comprising a lock collar, which is disposed in the central opening of the rotor member of the gerotor displacement mechanism.

3. A rotary fluid pressure device as claimed in claim 1, wherein the lock piston is in substantial alignment with the central opening of the rotor member of the gerotor displacement mechanism during at least one point in the orbital movement of the rotor member.

4. A rotary fluid pressure device as claimed in claim 1, further comprising a spring that acts against the lock piston to bias the lock piston to the engaged position.

5. A rotary fluid pressure device as claimed in claim 1, wherein the lock piston defines at least one hole.

6. A rotary fluid pressure device as claimed in claim 1, further comprising a fluid passage that provides fluid communication between a source of fluid pressure and the release piston.

7. A rotary fluid pressure device as claimed in claim 6, further comprising a valve assembly that provides fluid communication between the fluid passage and the source of fluid pressure.

8. A rotary fluid pressure device as claimed in claim 7, wherein the valve assembly is a 3-position, 5-way valve assembly.

9. A rotary fluid pressure device as claimed in claim 7, wherein the valve assembly is a shuttle valve assembly.

10. A rotary fluid pressure device comprising:
- a valve member;
- a gerotor displacement mechanism in fluid communication with the valve member, the gerotor displacement mechanism including:
  - a ring member defining an axis, wherein the ring member rotates about the axis;
  - a rotor member eccentrically disposed in the ring member, the rotor member orbiting about the axis of the ring member, the rotor member defining a plurality of internal splines and a first central opening;
- a drive shaft having a first end and an oppositely disposed second end, the first end being engaged to the internal splines of the rotor member, the drive shaft defining an axial bore that extends through the first and second ends of the drive shaft;
- a brake pin slidably disposed in the axial bore of the drive shaft, the brake pin having a first axial end and a second axial end;
- a release piston disposed against the first axial end of the brake pin; and
- a lock piston acting against the second axial end of the brake pin, the lock piston having a forward portion and a rearward portion, the lock piston being moveable between an engaged position and a disengaged position, the forward portion of the lock piston being disposed in the first central opening of the rotor member in the engaged position to prevent the rotor member from orbiting, the release piston acting against the first axial end of the brake pin to move the lock piston to the disengaged position;
- a spring acting against the rearward portion of the lock piston to bias the lock piston to the engaged position.

11. A rotary fluid pressure device as claimed in claim 10, further comprising an end cap disposed adjacent to the gerotor displacement mechanism, the end cap defining a piston cavity that receives the lock piston.

12. A rotary fluid pressure device as claimed in claim 11, wherein the piston cavity in the end cap is of a cylindrical shape.

13. A rotary fluid pressure device as claimed in claim 10, wherein the valve member defines a second central opening, the release piston being slidably disposed in the second central opening.

14. A rotary fluid pressure device as claimed in claim 13, further comprising a release piston ring disposed in the second central opening.

15. A rotary fluid pressure device as claimed in claim 10, further comprising a fluid passage that provides fluid communication between a source of fluid pressure and the release piston.

16. A rotary fluid pressure device as claimed in claim 15, further comprising a valve assembly that provides fluid communication between the fluid passage and the source of fluid pressure.

17. A rotary fluid pressure device as claimed in claim 16, wherein the valve assembly is a 3-position, 5-way valve assembly.

18. A rotary fluid pressure device comprising:

a housing defining a fluid inlet and a fluid outlet;

a gerotor displacement mechanism defining a plurality of expanding and contracting volume chambers that are in fluid communication with the fluid inlet and the fluid outlet, the gerotor displacement mechanism including:

a ring member defining an axis, wherein the ring member rotates about the axis;

a rotor member eccentrically disposed in the ring member, the rotor member orbiting about the axis of the ring member, the rotor member defining a plurality of internal splines and a first central opening;

an end cap disposed adjacent to the gerotor displacement mechanism, the end cap defining a piston cavity;

a drive shaft having a first end and an oppositely disposed second end, the first end being engaged to the internal splines of the rotor member, the drive shaft defining an axial bore that extends through the first and second ends of the drive shaft;

a brake pin slidably disposed in the axial bore of the drive shaft, the brake pin having a first axial end and a second axial end;

a release piston disposed against the first axial end of the brake pin; and a lock piston disposed in the piston cavity and acting against the second axial end of the brake pin, the lock piston having a forward portion and a rearward portion, the lock piston being moveable between an engaged position and a disengaged position, the forward portion of the lock piston being disposed in the first central opening of the rotor member in the engaged position to prevent the rotor member from orbiting, the release piston selectively acting against the first axial end of the brake pin to move the lock piston to the disengaged position;

a spring acting against the rearward portion of the lock piston to bias the lock piston to the engaged position.

19. A rotary fluid pressure device as claimed in claim 18, further comprising a lock collar disposed in the first central opening of the rotor member of the gerotor displacement mechanism, the lock collar receiving the forward portion of the lock piston when the lock piston is in the engaged position.

20. A rotary fluid pressure device as claimed in claim 18, further comprising a release piston ring defining a release piston cavity, in which the release piston is slidably disposed.

* * * * *